US008586816B2

(12) United States Patent
Pieper et al.

(10) Patent No.: US 8,586,816 B2
(45) Date of Patent: Nov. 19, 2013

(54) RECYCLING FLUSH STREAMS IN ADSORPTION SEPARATION PROCESS FOR ENERGY SAVINGS

(75) Inventors: Jeffrey L. Pieper, Des Plaines, IL (US); Stephen W. Sohn, Arlington Heights, IL (US); Peter M. Bernard, Chicago, IL (US); Cynthia K. Zimmerman, Palatine, IL (US)

(73) Assignee: UOP LLC, Des Plaines, IL (US)

( * ) Notice: Subject to any disclaimer, the term of this patent is extended or adjusted under 35 U.S.C. 154(b) by 55 days.

(21) Appl. No.: 13/324,013

(22) Filed: Dec. 13, 2011

(65) Prior Publication Data

US 2012/0157744 A1 Jun. 21, 2012

Related U.S. Application Data

(60) Provisional application No. 61/424,846, filed on Dec. 20, 2010.

(51) Int. Cl.
*C07C 7/12* (2006.01)

(52) U.S. Cl.
USPC ..... 585/822; 585/820; 585/821; 585/827

(58) Field of Classification Search
None
See application file for complete search history.

(56) References Cited

U.S. PATENT DOCUMENTS

| | | | | |
|---|---|---|---|---|
| 5,750,820 | A * | 5/1998 | Wei | 585/826 |
| 5,912,395 | A * | 6/1999 | Noe | 585/820 |
| 7,960,601 | B2 * | 6/2011 | Noe et al. | 585/822 |
| 2006/0199989 | A1 | 9/2006 | Frey | |
| 2009/0247806 | A1 | 10/2009 | Porter | |

FOREIGN PATENT DOCUMENTS

EP 1060776 A1 12/2000

OTHER PUBLICATIONS

U.S. Appl. No. 12/972,953, filed Dec. 20, 2010, Pieper et al.

* cited by examiner

*Primary Examiner* — Tam M Nguyen
(74) *Attorney, Agent, or Firm* — Arthur E Gooding

(57) ABSTRACT

A process to reduce flush circulation rates in an adsorption separation system is presented. The flush stream is used to improve the capacity of the simulated moving bed system by flushing the contents of the transfer lines containing raffinate material back into the adsorbent column. The flush stream is a material that is used to flush the head chambers in the column, or from the rotary valve flush dome sealant.

23 Claims, 2 Drawing Sheets

RECYCLING FLUSH STREAMS IN ADSORPTION SEPARATION PROCESS FOR ENERGY SAVINGS

CROSS-REFERENCE TO RELATED APPLICATION

This application claims the benefit of U.S. Provisional Application No. 61/424,846 filed on Dec. 20, 2010.

FIELD OF THE INVENTION

The invention relates to adsorption separation processes. The invention is specifically directed at a process to improve the capacity and capabilities of an adsorption separation system using recycle streams.

BACKGROUND OF THE INVENTION

The separation of various substances through selective adsorption is an important process for producing pure substances. However, this generally is a batch process, but with the development of simulated moving bed (SMB) technology, the adsorption separation process can be operated on a continuous basis. For simulated moving bed technology, the process uses a multiport rotary valve to redirect flow lines in the process. The simulation of a moving adsorbent bed is described in U.S. Pat. No. 2,985,589 (Broughton et al.). In accomplishing this simulation, it is necessary to connect a feed stream to a series of beds in sequence, first to bed no. 1, then to bed no. 2, and so forth for numerous beds, the number of beds often being between 12 and 24. These beds may be considered to be portions of a single large bed whose movement is simulated. Each time the feed stream destination is changed, it is also necessary to change the destinations (or origins) of at least three other streams, which may be streams entering the beds, such as the feed stream, or leaving the beds. The moving bed simulation may be simply described as dividing the bed into series of fixed beds and moving the points of introducing and withdrawing liquid streams past the series of fixed beds instead of moving the beds past the introduction and withdrawal points. A rotary valve used in the Broughton process may be described as accomplishing the simultaneous interconnection of two separate groups of conduits.

There are many different process requirements in moving bed simulation processes, resulting in different flow schemes and thus variations in rotary valve arrangement. For example, in addition to the four basic streams described in Broughton (U.S. Pat. No. 2,985,589), it may be desirable to utilize one or more streams to purge, or flush, a pipeline or pipelines. A flush stream is used to prevent undesirable mixing of components. The flush substance is chosen to be one which is not undesirable for mixing with either main stream, that being purged or that which enters the pipeline after flushing is completed. U.S. Pat. No. 3,201,491 (Stine et al.) may be consulted for information on flushing lines as applied to the process of Broughton (U.S. Pat. No. 2,985,589). It may be desirable to pass fluid through a bed or beds in the reverse direction from normal flow. This is commonly known as backflushing, a subject treated in U.S. Pat. No. 4,319,929 (Fickel). Other applications for various arrangements of multiport rotary disc valves may be seen in U.S. Pat. No. 4,313,015 (Broughton); U.S. Pat. No. 4,157,267 (Odawara et al.); U.S. Pat. No. 4,182,633 (Ishikawa et al.); and U.S. Pat. No. 4,409,033 (LeRoy).

While the multiport rotary disc valve of Carson (U.S. Pat. No. 3,040,777) provided a satisfactory valve design for the simultaneous interconnection of two independent groups of conduits such that each conduit of the first group could be brought into individual communication with every conduit of the second group, it is not suitable when three groups of conduits must be simultaneously interconnected in the same manner. Upon reference to Broughton (U.S. Pat. No. 2,985,589), it can be seen that there are only two groups of conduits which need to be interconnected when the arrangement of the drawing of that patent is utilized. One group consists of the conduits which provide the flows entering and leaving the simulated moving bed adsorbent system, that is, the flows which are switched among the beds, such as the feed stream. A second group consists of the conduits associated with the individual beds, that is, which supply and remove fluid from the beds, one conduit being connected between each two beds. It is to be noted that each conduit of the second group serves that dual function of supply and removal, so that it is unnecessary to provide conduits for supplying fluid separate from those for removing fluid.

Adsorption separation uses expensive equipment, and the equipment is not readily replaced to increase the production of a product stream. With increasing demand for the products from adsorption separation processes, increasing the throughput and recovery of the products is desirable without having to replace the equipment.

SUMMARY OF THE INVENTION

This invention is an improvement to the adsorption separation process that utilizes a simulated moving bed process. The simulated moving bed system comprises a multiport adsorption column where the ports are sequentially used to admit and withdraw fluid streams. The process is for the separation of selected components from a hydrocarbon mixture, where the selected components are preferentially adsorbed onto the adsorbent while the remaining components are swept out of the adsorption column. The process includes passing a feedstream comprising the hydrocarbon mixture to a first port in the adsorption column. A desorbent stream is passed to a second port in the adsorption column, and an extract stream is withdrawn from a third port comprising the preferentially selected components. A raffinate stream is withdrawn from a fourth port comprising the non-adsorbed components from the feedstream. The process further includes passing a zone flush stream through the transfer line and a fifth port, where the transfer line was used in the prior step for the removal of raffinate. The zone flush stream is the fluid used for the rotary valve dome sealant. The rotary valve comprises a rotating disc that connects different channels to direct the flow of the different fluids. The dome sealant keeps the valve parts under pressure and to provide lubrication to prevent leakage of the processing fluids.

In another embodiment, the dome sealant is used to flush out the upper and lower head chambers of the adsorption column.

Other objects, advantages and applications of the present invention will become apparent to those skilled in the art from the following detailed description and drawings.

DETAILED DESCRIPTION OF THE INVENTION

Figure 1:
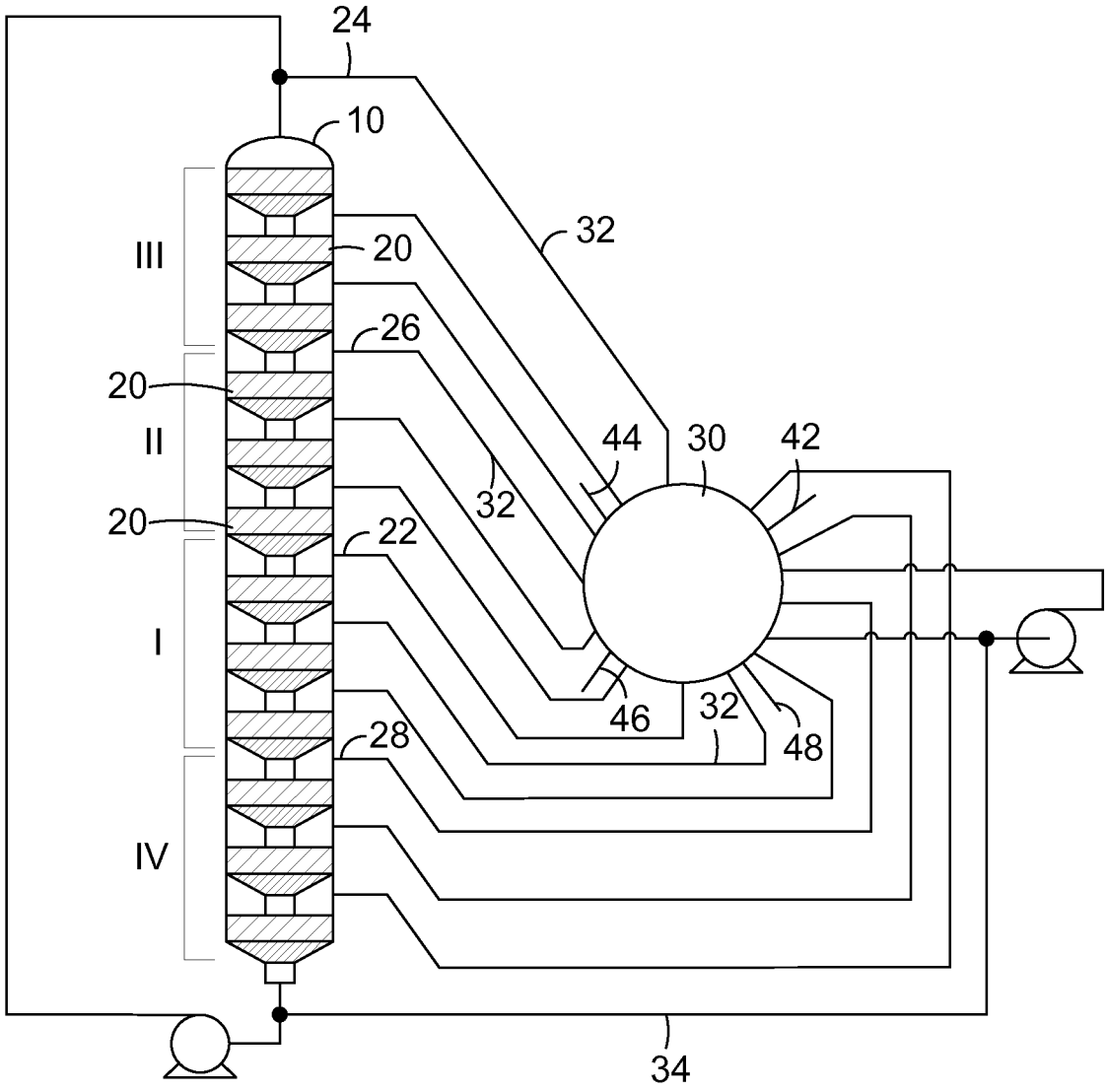
FIG. 1 is a diagram of the continuous adsorption separation system with a flush system.

Adsorption separation is an important process in the petrochemical industry for the separation and recovery of selected groups of hydrocarbons from a general hydrocarbon stream. While many separation processes are used, the subsequent product stream often require further separation and purification for the recovery of specific components in a selected product stream. Adsorption separation provides a process for selective separation and purification of a component from a mixture of close boiling point range hydrocarbons. For example, distillation is used to provide gross cuts, or separation, of petroleum in to selected boiling point range product streams. Each boiling point range product stream comprises a broad range of components that can have higher value products within that stream. One such stream might be a kerosene cut, which can be separated into a stream of normal paraffins and olefins, and a stream of non-normal hydrocarbons. Adsorption separation can provide the means to separate the kerosene cut into those product streams. Component separation is energy intensive, and means for increasing demand means increasing capacity for production. With adsorption separation systems, higher capacity and higher flush rates are needed to meet this increased demand. This results in higher separation column duties, higher tray loadings and higher circulation rates.

The present invention can achieve an increase in capacity in an adsorption separation system through clearing residual amounts of separated components from the rotary valve. This in turn reduces the flush circulation rates for the adsorption separation process, and results in energy savings for the columns. The present invention is a continuous process for the separation of components in a feedstream with an adsorption separation system, where the feedstream comprises a hydrocarbon mixture. The adsorption separation system comprises a plurality of zones that are serially connected through fluid connections, and where there is a port between each pair of zones for the admission of a fluid or the withdrawal of a fluid. The adsorption separation system is described herein as a column, having a plurality of beds stacked within the column. Although described as a column, the present invention is not meant to be limited as such.

The process comprises passing the feedstream to an adsorbent bed through a first port, where the feedstream flows over an adsorbent bed and at least one component in the mixture is preferentially adsorbed by the adsorbent, and where the non-preferentially adsorbed components remain in the fluid phase.

The process further includes passing a desorbent stream comprising a desorbent through a second port to the adsorbent bed. An extract stream is withdrawn from a third port, and comprises the preferentially adsorbed component extracted from the feedstream. A raffinate stream is withdrawn from a fourth port, and is a fluid stream comprising the non-preferentially adsorbed components from the feedstream.

Each stream passing through a port in the adsorbent system passes through a transfer line and is directed to that transfer line through a channel in a rotary valve. The rotary valve increments the transfer lines in a sequential manner to simulate the countercurrent flow of the solid adsorbent by moving the inlet and outlet ports along the length of the column. The process further includes passing a zone flush through the rotary valve between the feed and extract zones, thereby creating a rotary valve flush stream. The rotary valve flush stream acts as a buffer between the extract and purification zones in the column. The flush stream from the rotary valve is then passed to a fifth port in the adsorption column. The flush stream is then passed to a transfer line to a port in the column, where the port selected is the port which previously carried the raffinate stream from the column. The fifth port is the port positioned one port above, or upstream, of the fourth port, or the raffinate port. The transfer line to the port, prior to the passing of the flush stream, is still full of raffinate, and the residual raffinate is pushed out to limit back mixing of raffinate when the feedstream reaches this transfer line. The back-mixing impairs the separation of the components in the adsorption separation process.

For purposes of this invention, the terms upstream and downstream when used in reference to the movement of incrementing of the ports for the transfer line connections, upstream refers to the direction that the port has already been, and downstream refers to the direction the port is being moved.

The simulated moving bed adsorption separation simulates the counter-current contact of a feedstream with an adsorbent. In a simulated context, the fluid flows down the column of beds, and the solid adsorbent moves up the column of beds through 4 zones in the process. In actuality, the zones move down the bed, as the different streams are added or withdrawn from the column, and the positions of the streams entering and leaving the column also move to coincide with the shifting of the zones.

The process has an adsorption zone, or Zone I, of the chamber where the feedstream contacts the adsorbent and selectively adsorbs the desired components. This removes the selected components from the flowing liquid, which becomes the raffinate stream. The raffinate stream is removed from the bottom of Zone I where the desired components have been adsorbed onto the adsorbent leaving the undesired components in the raffinate stream. As the process is a continuous process, the raffinate stream also includes any residual desorbent left in the column as the process stream flows through the column.

After the feedstream has passed through the purification zone, a liquid desorbent is added to the desorption zone, or Zone III, where the desorbent displaces the selected component that has been adsorbed on the adsorbent. Zone III is separated from Zone I by the purification Zone II. The stream comprising the desorbent and the selected component makes up the extract stream which is removed from the column. The desorbent is selected to readily displace the selected component, but is also selected to be readily separated from the selected component in a distillation process.

Zone I and Zone III are also separated by a buffer Zone IV, to prevent the contamination of liquid from Zone III with the liquid from Zone I. More information on the process is available in numerous patents and references, including U.S. Pat. No. 5,912,395, which is incorporated by reference in its entirety.

As can be seen in FIG. 1, the process involves a stack of adsorbent beds in a column, and the column is divided into the 4 zones. In FIG. 1, the column 10 is simplified to have only 12 adsorbent beds 20, whereas a preferred column will have at least 20 adsorbent beds. The feedstream 22 enters the column through a first port at the top of the top bed in Zone I. The desorbent stream 24 enters through a second port at the top of the top bed in Zone III. An extract stream 26 is withdrawn from a third port at the bottom of the bottom bed in the desorption zone, or Zone III. A raffinate stream 28 is withdrawn from a fourth port at the bottom of the bottom bed in the adsorption zone, or Zone I. The process increments the ports simultaneously with all the inlet and outlet ports moving down the column, and the incrementing of the ports is controlled through a rotary valve 30. The fluids are passed through the rotary valve 30 to transfer lines to the column 10. The rotary valve 30 also includes a feedstream line 42, a raffinate line 44, a desorbent line 46 and an extract line 48, for admitting and withdrawing the four streams to and from the column 10. The adsorption separation system can be designed with multiple columns, wherein the fluid is transferred from the bottom of one column to the top of another column, thereby operating as a larger column with multiple beds. While the process is presented with only one column in the description, a preferred design uses two columns, and the present invention is intended to cover the option of multiple columns as well as a single column.

It is apparent when a transfer line is no longer used, the liquid in the transfer line will contain components from the stream left in the line at the time the rotary valve increments the position of the streams. One method of improving the separation is presented in U.S. Pat. No. 5,912,395 which uses a quantity of feedstream to flush a line that had just been used to transfer raffinate.

The present invention is for the separation of normal paraffins from a kerosene stream. The hydrocarbons in the kerosene stream have from 10 to 16 carbon atoms. The desorbent used in the present invention is a smaller normal paraffin used to displace the larger normal paraffins from the kerosene stream, and comprises at least one normal paraffin in the C5 to C8 range. The desorbent can include a mixture of a normal paraffin in the C5 to C8 range with a non-normal paraffin. One example of a desorbent stream is n-pentane and isooctane. The flush stream in the present invention can comprise a branched or cyclic hydrocarbon having from 6 to 8 carbon atoms. The can comprise isoparaffins, and can also comprise alkylaromatics. The flush stream can also be a mixture of isoparaffins and alkylaromatics. The alkylaromatics that are preferred are C6 to C9 alkylaromatics, with C8 alkylaromatics more preferred. One most preferred aromatic compound is para-xylene, and a mixture of isooctane and para-xylene is a preferred mixture. The choice of flush material can cover a broad range of hydrocarbon compounds. The considerations for selection include compounds that are small enough to be readily separated from the kerosene hydrocarbons, and for the compounds to be non-normal such that the flush compounds will not occupy the pores in the adsorbent.

The present invention adds a flush line 34 to pass a flush stream through the transfer line that had just previously carried raffinate. This is through a fifth port that is positioned one port above the raffinate port. The flush stream pushes the material into the column and creates a clean line that is ready to receive the feedstream. The flush stream can also flush out the channel in the rotary valve. The process comprises using a generally set amount of flush stream through each transfer line. The amount is chosen based upon the total volume of the longest transfer line, or bed line, and the channel in the rotary valve. The amount needed to flush the line is between 0.5 and 3 times the volume of the channel in the rotary valve and the longest transfer line. Preferably, the amount can be controlled to be an amount between 1 and 2 times the volume of the channel in the rotary valve and the longest transfer line.

In one embodiment, the process includes withdrawing the flush stream from the adsorbent bed line that previously contained raffinate. The flush stream is withdrawn before the feedstream is passed through the adsorbent bed line, and the flush stream is passed to the raffinate stream. The flush stream passes through the rotary valve channel in a sequence that is immediately before the passing of the feedstream through the rotary valve channel. The feedstream is then passed to the transfer line, or bedline, to the adsorbent bed.

The adsorption separation system includes at the top of the adsorption column, an upper head region, and at the bottom of the adsorption column a lower head region. The upper head region is above the first adsorbent bed, and the lower region is below the last adsorbent bed. The upper and lower head region are regions where the hydrocarbon streams mix and need to be flushed to prevent back mixing and dilution of any of the component streams that are withdrawn from the column. In one embodiment, the flush stream is passed through the upper head region, and passed through the lower head region.

The upper head region is swept with the flush stream prior to the passing of the feedstream to the first adsorbent bed. The feed position to the first adsorbent bed is above the first bed, and will mix with any fluid in the upper head region. The lower head region is swept with the flush stream after the feedstream is passed to the last adsorbent bed to sweep out the feedstream components that are not adsorbed in the last adsorbent bed, and to prevent the mixing of the extract stream with residual feedstream in the lower head region. The flush stream can then be passed to a transfer line and port that is one position upstream of the port used to withdraw raffinate from the column.

Figure 2:
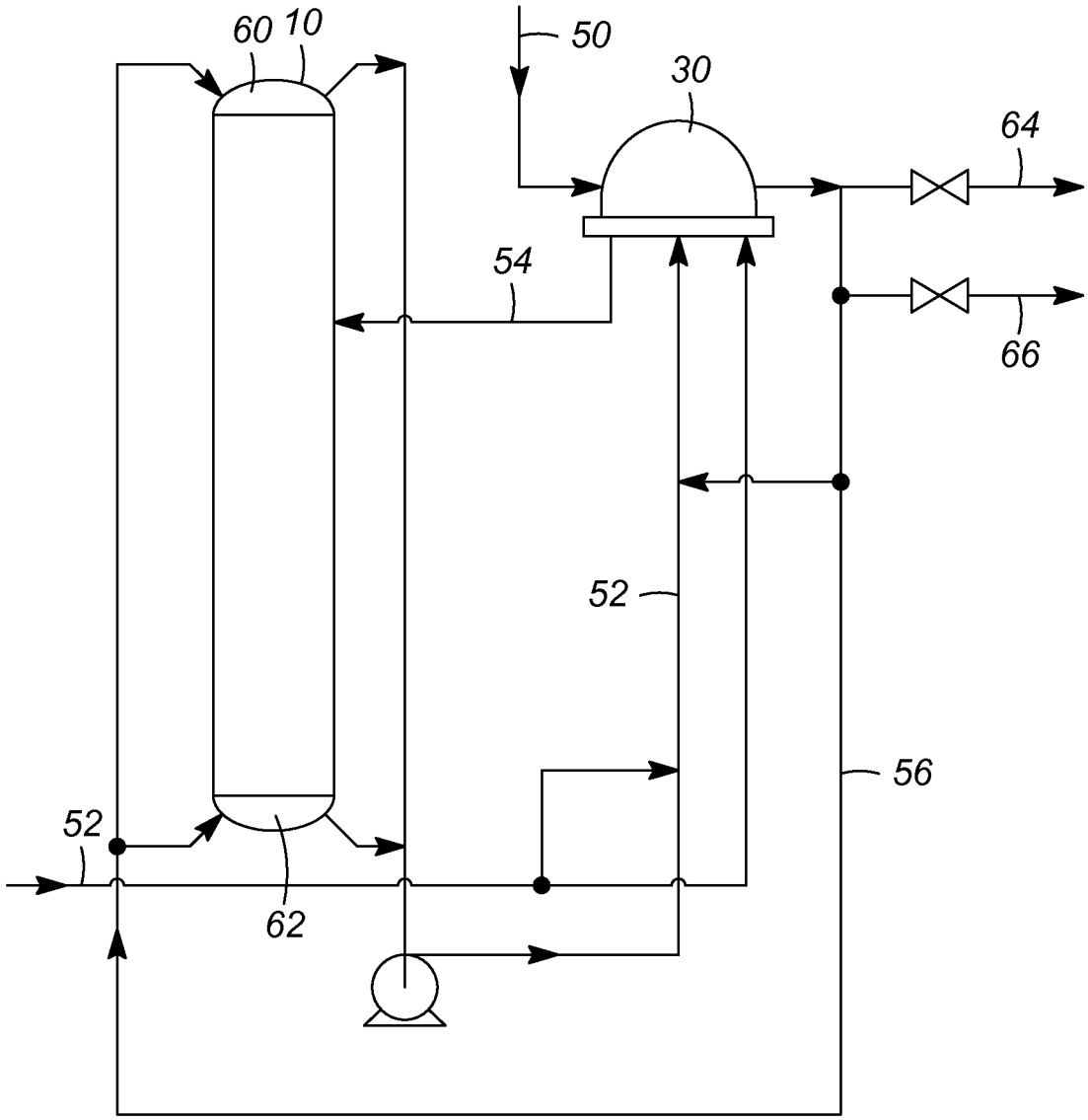
FIG. 2 is a diagram of the flow of the dome sealant.

The present invention adds a flush line 34 to pass a dome sealant stream through the transfer lines, to the adsorbent column 10, as shown in FIG. 2. The dome sealant is passed to a transfer line 54, which is a transfer line that is contains residual raffinate, before the line is used for a feedstream. The dome sealant stream 50 is passed from a flush filter. The dome sealant can be used as a flush stream to reduce the amount of recirculating flush streams in the system. The dome sealant stream is passed through a filter to remove material, such as collected solids, that can affect the sealants ability to maintain a seal in the rotary valve dome. The dome sealant material is a hydrocarbon material that will not fill the pores of the adsorbent, and will have a different boiling point from the desorbent or the material being separated, that is, the raffinate components and the selectively adsorbed material.

In one embodiment, the dome sealant stream 50 passes through the rotary valve 30. The dome sealant can be recycled through the flush filter, or can be used as a process stream in flushing the lines. The process comprises an adsorption separation system as described above, with the addition of passing the dome sealant stream to a line flush 52. The amount of dome sealant used as a line flush is between 50% and 300% of the volume of the longest transfer line between the rotary valve 30 and the adsorption separation column 10. The dome flush stream 50 used as a line flush 52 can originate from the flush filter, or pass through the dome of the rotary valve 30. The dome sealant used in a line flush 52 passes through a channel in the rotary valve and to a transfer line 54. The rotary valve directs the flow to a transfer line in communication with a fifth port in the column 10. The fifth port is a port just upstream of the port that is withdrawing raffinate from the column 10.

In another embodiment, the dome sealant stream 50 is used as a zone flush stream. The dome sealant is passed through the rotary valve 30 to a transfer line 54, where the transfer line is in fluid communication with a zone in the column for the separation of the raffinate components from the selectively adsorbed component to prevent contamination following separation.

In another embodiment, the dome sealant stream 50 can be passed to the column 10 to be used as a head flush stream 56. The head flush stream 56 passes through the upper head 60 of the column 10 and at a different time in the adsorption separation cycle, through the lower head 62 of the column 10.

The dome sealant stream after passing through the column 10 picks up material from the column 10. In some passes, the material picked up into the dome sealant stream includes desorbent. The resultant stream 64 of dome sealant and desorbent can be passed to a desorbent stripper to separate out the desorbent. The desorbent and dome sealant streams are then recycled to the process. The dome sealant stream can also pick up raffinate components as the dome sealant stream is used to flush raffinate material from the transfer lines. The resultant stream 66 of dome sealant and raffinate components is passed to the raffinate column, where the dome sealant is separated. The raffinate components are then passed to other units, and the dome sealant is recycled for use in the adsorption separation system.

The invention seeks to reduce the flush circulation rates by recycling the flush streams from the rotary valve dome sealant, or from the head flushes. This can reduce the amount of flush streams by 10% to 15% of the circulation of the flush stream, and results in an energy savings from lower energy used in subsequent distillation column separations.

While the invention has been described with what are presently considered the preferred embodiments, it is to be understood that the invention is not limited to the disclosed embodiments, but it is intended to cover various modifications and equivalent arrangements included within the scope of the appended claims.

The invention claimed is:

1. A continuous process for the separation of components in a feedstream with an adsorption separation system, comprising:

passing the feedstream of a hydrocarbon mixture of fluid components to an adsorbent bed through a first port, wherein at least one component is preferentially adsorbed by the adsorbent and where non-preferentially adsorbed components remain in the fluid phase, and where the adsorbent bed comprises a plurality of zones that are serially connected through fluid connections, wherein between each zone there is a port for admitting a fluid stream, or withdrawing a fluid stream;

passing a desorbent stream comprising a desorbent into the adsorbent bed at a second port than the feedstream;

withdrawing an extract stream at a third port comprising the preferentially adsorbed component;

withdrawing a raffinate stream comprising the non-preferentially adsorbed components at a fourth port;

wherein the admission or withdrawal of a stream through a port is directed through a channel in a rotary valve to a transfer line in fluid communication with a port;

passing a flush stream recycled from the fractionation section of the adsorbent separation system to the upper head region and lower head region of the adsorbent separation system creating head flush inlet streams and head flush outlet streams;

passing a flush stream recycled from the fractionation section of the adsorbent separation system through the rotary valve creating a dome sealant in let stream and a dome sealant outlet stream;

passing a flush stream through the rotary into the adsorbent bed downstream of the extract stream to create a purification zoned wherein the purification zone is a zone between the feed stream and the extract stream; and passing the rotary valve flush stream through a fifth port;

wherein the flush stream comprises at least a portion of one of the flush stream recycled through at least one of (i) the rotary valve dome sealant outlet stream; and (ii) one of the head flush outlet streams to flush out the upper and/or lower head region of the adsorption column and combined with the remaining portion of the flush recycled from the fractionation section of the adsorbent separation system.

2. The process of claim 1 further comprising passing a portion of the rotary valve flush stream through the transfer line connecting the rotary valve to the adsorbent bed which had just previously carried raffinate stream is passed into the bed of adsorbent.

3. The process of claim 1 wherein the hydrocarbon feedstream comprises kerosene and the desorbent comprises a normal paraffin in the C5 to C8 range.

4. The process of claim 1 wherein the hydrocarbon feedstream comprises kerosene range hydrocarbons and the desorbent comprises normal pentane.

5. The process of claim 1 wherein the flush stream comprises a branched or cyclic C6 to C8 hydrocarbon.

6. The process of claim 5 wherein the flush stream comprises C8 isoparaffins.

7. The process of claim 5 wherein the flush stream comprises a mixture of C8 isoparaffins and C8 alkylaromatics.

8. The process of claim 7 wherein the flush stream comprises a mixture of isooctane and paraxylene.

9. The process of claim 1 wherein the amount of the flush stream through the rotary valve channel is equal to 0.5 to 3 times the volume of the channel in the rotary valve and the longest bed line connecting the rotary valve to the adsorbent bed.

10. The process of claim 9 wherein the amount of the flush stream through the rotary valve channel is equal to 1 to 2 times the volume of the channel in the rotary valve and the longest bed line connecting the rotary valve to the adsorbent bed.

11. The process of claim 1 further comprising withdrawing the flush stream from the adsorbent bed line that previously contained raffinate and before use by the feedstream with the flush stream passed to the raffinate stream.

12. The process of claim 11 wherein the flush stream is withdrawn from the rotary channel immediately before the rotary chamber is used for passing the feedstream through the bedline to the adsorbent bed.

13. The process of claim 1 wherein the adsorption separation system comprises a plurality of adsorbent beds with an upper head region above the first adsorbent bed, and a lower head region below the last adsorbent bed, further comprising:

passing the flush stream through the upper head region; and passing the flush stream through the lower head region.

14. The process of claim 13 wherein the flush stream is passed through the upper head region before passing the feedstream to the first adsorbent bed.

15. The process of claim 13 wherein the flush stream is passed through the lower head region after the feedstream is passed to the last adsorbent bed.

16. The process of claim 13 wherein the flush stream is passed to a port one position upstream of the raffinate withdrawal port after the flush stream passed through either the upper head region or the lower head region.

17. The process of claim 1 wherein the flush stream is passed to a port one position upstream of the raffinate withdrawal port.

18. The process of claim 1 further comprising passing the flush stream through as a line flush.

19. The process of claim 1 further comprising passing the flush stream through as a zone flush.

20. The process of claim 1 further comprising passing the flush stream to a raffinate separation unit, thereby creating a recovered desorbent stream, a recovered dome sealant stream, and a raffinate product stream.

21. The process of claim 1 further comprising passing the flush stream to a desorbent stripper, thereby creating a desorbent stream and a dome sealant stream.

22. The process of claim 1 further comprising passing the dome sealant through a flush filter.

23. The process of claim 1 wherein the fifth port is one port upstream of the port which had just previously carried raffinate stream is passed into the bed of adsorbent.

* * * * *